US008100439B2

(12) United States Patent
Gerner et al.

(10) Patent No.: US 8,100,439 B2
(45) Date of Patent: Jan. 24, 2012

(54) DEVICE FOR FIXING A DOOR OR FLAP

(75) Inventors: Jürgen Gerner, Schwendi (DE); Georg Dorner, Steinhausen (DE)

(73) Assignee: Liebherr - Hausgeräte Ochsenhausen GmbH, Ochsenhausen (DE)

( * ) Notice: Subject to any disclaimer, the term of this patent is extended or adjusted under 35 U.S.C. 154(b) by 0 days.

(21) Appl. No.: 12/150,962

(22) Filed: May 2, 2008

(65) Prior Publication Data

US 2008/0284179 A1 Nov. 20, 2008

(30) Foreign Application Priority Data

May 4, 2007 (DE) ..... 20 2007 006 402 U
Sep. 24, 2007 (DE) ..... 20 2007 013 338 U

(51) Int. Cl.
*E05C 19/00* (2006.01)

(52) U.S. Cl. ..... 292/1; 292/DIG. 15; 292/DIG. 16; 292/303; 292/DIG. 338

(58) Field of Classification Search ..... 292/1, 3–13, 292/17–20, 28, 37, 38–50, 56, 76, 65, 83–84, 292/111, 124, 125, 181, 140, 141, 152, 153, 292/240, 224, 215, 197, 209, 210, 303, DIG. 15, 292/DIG. 16, DIG. 38, 225, 304, 341.12, 292/341.13, 341.15, DIG. 17 X, DIG. 71, 292/DIG. 41
See application file for complete search history.

(56) References Cited

U.S. PATENT DOCUMENTS

| | | | | | |
|---|---|---|---|---|---|
| 444,019 | A | * | 1/1891 | Richards | 292/17 |
| 504,142 | A | * | 8/1893 | Wilburn | 292/17 |
| 984,118 | A | * | 2/1911 | Wilcox | 292/17 |
| 1,931,695 | A | * | 10/1933 | Hall | 292/17 |
| 2,511,998 | A | * | 6/1950 | Rummelsburg | 292/17 |
| 2,711,335 | A | * | 6/1955 | Carroll | 292/18 |
| 4,466,645 | A | * | 8/1984 | Kobayashi | 292/341.12 |
| 4,881,764 | A | | 11/1989 | Takahashi et al. | |
| 5,711,554 | A | * | 1/1998 | Brown et al. | 292/19 |
| 6,038,892 | A | * | 3/2000 | Schmitt | 70/78 |
| 2005/0225094 | A1 | * | 10/2005 | Lewis et al. | 292/19 |

FOREIGN PATENT DOCUMENTS

| | | |
|---|---|---|
| CH | 494 885 | 8/1970 |
| DE | 23 19 302 | 10/1974 |
| DE | 299 12 563 | 11/2000 |
| DE | 10 2006 006 575 | 6/2007 |

* cited by examiner

*Primary Examiner* — Thomas A Beach
*Assistant Examiner* — Mark Williams
(74) *Attorney, Agent, or Firm* — Dilworth & Barrese, LLP.

(57) ABSTRACT

The present invention relates to a device for fixing a door or flap, in particular a door or flap of a refrigerator and/or freezer, in the closed position, wherein the device includes a spring element and a holding element, in particular a closing cam, which are arranged such that in the closed position of the door or flap they cooperate such that separating the spring element and the holding element from each other only is possible by applying force, wherein the spring element is a leaf spring.

15 Claims, 4 Drawing Sheets

PRIOR ART

DEVICE FOR FIXING A DOOR OR FLAP

BACKGROUND OF THE INVENTION

The present invention relates to a device for fixing a door or flap, in particular a door or flap of a refrigerator and/or freezer, in the closed position, wherein the device includes a spring element and a holding element, in particular a closing cam, which are arranged such that in the closed position of the door or flap they cooperate such that separating the spring element and the holding element from each other only is possible by applying force.

A safe closing of a door or flap of a refrigerator generally is realized by means of a spring element located on the refrigerator door and with a closing cam located for instance on the bearing block. In the closed condition of the door or flap, the spring element encloses the closing cam in arrangements known from the prior art. The clamping force of the door or flap very much depends on the material of the spring element and on the geometry thereof. To achieve a sufficient clamping force in the case of heavy doors, the spring element must be made very "stiff", which means that for deforming the spring element a comparatively large deformation force is necessary. This means that comparatively large tensions are achieved in the spring element.

Prior art spring elements are made of plastic material with the disadvantage that the admissible tensions in the component are small. This means that only small deformation forces and mostly only small spring deflections are admissible.

SUMMARY OF THE INVENTION

Therefore, it is the object of the present invention to develop a device as mentioned above to the effect that also comparatively large tensions can easily be absorbed.

This object is solved by a device with the features herein.

Accordingly, it is provided that the spring element is a leaf spring. Preferably, it is provided that the leaf spring partly or completely includes a sheathing. It is conceivable, for instance, that the sheathing is made of plastic material, and preferably it is provided that the spring element is a leaf spring coated with plastic material.

It is the object of the leaf spring to generate the closing forces required for closing the door or flap. It can for instance be made of spring steel or also of some other suitable metal. As plastic material, which preferably constitutes a coating, wear-resistant plastics are preferred, which undergo little wear when the spring element is pushed onto a closing cam.

When the leaf spring is provided with a plastic coating, the spring can be designed as desired, and like in the case of a polymer spring as it is known from the prior art, a spring holder and other elements can also be injection-molded to the leaf spring. Accordingly, it can be provided that the leaf spring is connected with a spring holder, which serves to fix the spring element in a suitable seat. For this purpose, it can be provided in particular that the spring holder is arranged with one or more spring feet, which in turn can be mounted resiliently and serve for alignment of the spring element.

The spring holder and/or the spring feet can be made of plastic material and likewise preferably be configured as injection-molded elements.

The spring holder and/or the spring feet can be configured as one-piece elements.

The arrangement of the spring element largely can be as desired. It is conceivable, for instance, that the leaf spring is of the U-shaped or L-shaped type or also has any other suitable shape, for instance the shape of a hook.

The leaf spring can be bent in its terminal regions. It is conceivable, for instance, that the leaf spring is U-shaped and that bent regions are arranged in the ends of the legs. These bent regions can for instance be configured such that lug-shaped portions are present in the terminal region(s) of the leaf spring.

The present invention furthermore relates to a device for averaging the limitation of the opening angle of a door or flap, preferably of a door or flap of a refrigerator and/or freezer. It is known from the prior art to realize a limited opening of the door by means of a disk mounted on the pivot point of the door and by means of stop pins provided on the door or on the carcass. Two tracks are incorporated in said disk, wherein a stop pin disposed on the housing of the appliance engages in one track and a stop pin disposed on the door engages in the other track. Said tracks specify the maximum opening angle of the door or flap.

The present invention relates to a development of a device for limiting the opening angle, wherein its design need not necessarily be as described above. In accordance with the invention it is provided that the device includes a spring element for fixing a door or flap in the closed position or a seat for such spring element, or that the device includes a holding element, in particular a closing cam, or a seat for a holding element, which in the closed position of the door or flap cooperates with the spring element such that separating the spring element and the holding element from each other only is possible by applying force. In accordance with the invention, it thus is provided that the device not only includes means for limiting the opening angle of the door, but in addition includes a spring element or a holding element or seat for the same. Thus, the device relates to a unit of opening limiter and closing means.

In a preferred aspect of the invention it is provided that the spring element is configured in accordance with the description herein.

The device can include a hinge unit to be arranged on the door or flap, preferably a hinge plate, wherein the spring element or the seat for a spring element is arranged on the hinge unit. The hinge unit furthermore can include a bore for receiving a bearing pin. The hinge plate thus is pushed onto the bearing pin and is connected with the door of the appliance such that the hinge unit follows the movement of the door.

In a further aspect of the invention it is provided that the hinge unit furthermore includes the means for limiting the opening angle of the door or flap or parts of these means. It is conceivable, for instance, that a stop pin is arranged on the hinge unit.

In a further aspect of the invention it is provided that the device includes an opening limiter unit, preferably an opening limiter plate, in which a groove is arranged, in which runs a stop pin, preferably the stop pin of the hinge unit.

Furthermore, it can be provided that the device includes a bearing block on which a stop pin is arranged, wherein the opening limiter unit includes a further groove for receiving this stop pin.

This invention furthermore relates to a refrigerator and/or freezer with a door or flap, which is characterized in that the appliance includes a device for fixing a door or flap and/or a device with means for limiting the opening angle of a door or flap according to the description herein.

BRIEF DESCRIPTION OF THE DRAWINGS

Further details and advantages of the invention are explained in detail with reference to an embodiment illustrated in the drawing, in which.

DESCRIPTION OF THE PREFERRED EMBODIMENTS

Figure 1:
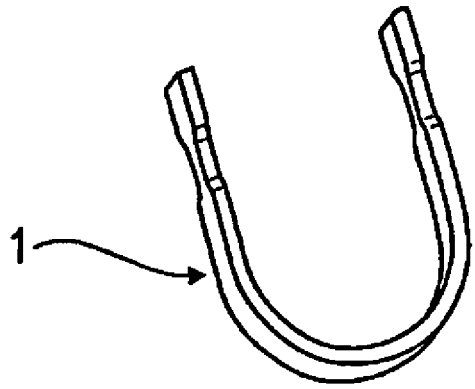
FIG. 1: shows a U-shaped leaf spring of a spring element in accordance with the invention.
Figure 2:
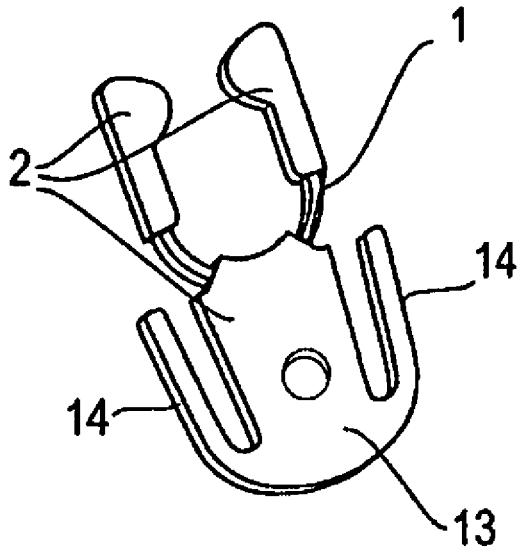
FIG. 2: shows the leaf spring of FIG. 1 in a partly coated configuration.

FIG. 1 shows the leaf spring 1 made for instance of spring steel, which constitutes the core of a spring element in accordance with the invention. In the configuration shown here, the leaf spring 1 is U-shaped. However, the invention is of course not restricted to this shape of the leaf spring. FIG. 2 shows the leaf spring 1 in a configuration in which it partly has a plastic sheathing 2. The plastic sheathing 2 substantially extends along the length of the straight legs of the U-shaped leaf spring 1 and in the curved region of the leaf spring 1. In this region, the plastic sheathing 2 constitutes a spring holder 13, on both sides of which two resilient spring feet 14 are arranged, which serve to fix and align the spring element in a suitable seat.

The core 1 of the leaf spring shown in FIG. 1 preferably is coated with a plastic material, such as POM or PA. As a material for coating or sheathing, wear-resistant plastics preferably are used, which undergo little wear when the spring is pushed onto a closing cam (see FIGS. 4, 5).

Figure 5:
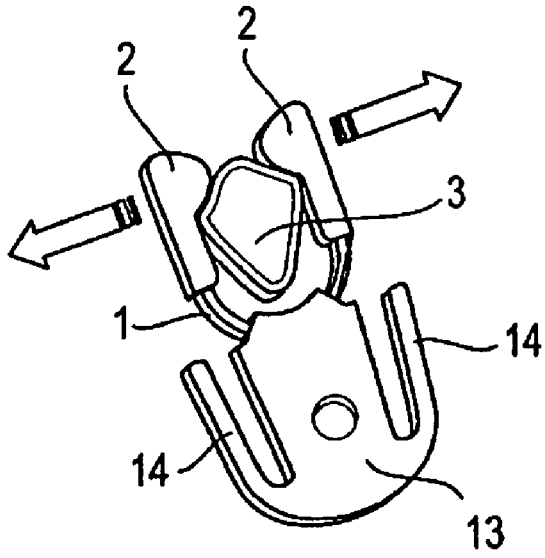
FIG. 5: shows the spring element of FIG. 2 with a closing cam received between the legs of the spring element.

As can be taken from FIG. 2, the plastic sheathing 2 includes two protrusions facing each other in the vicinity of the legs of the leaf spring 1, which are dimensioned such that they must be bent apart when the closing cam 3 should be moved out of the region defined by the legs of the leaf spring 1, as is the case when opening the door. This is schematically shown in FIG. 5. The arrows shown here designate the direction of deformation when the spring element is mounted on and detached from the cam 3.

In the embodiment as shown in FIG. 2, a partial region of the leaf spring, namely the region between the straight legs and the apex of the curved region of the U-shaped leaf spring, is not coated. It is furthermore conceivable to also perform a partial coating such that in peripheral direction of the leaf spring a partial region is spared, which means for instance that a certain portion of the leaf spring is not completely, but only partly, provided with a plastic sheathing, for instance on the inside. In so far, the term "sheathing" should be taken broadly and also comprises embodiments in which the sheathing does not completely surround the leaf spring.

Figure 3:
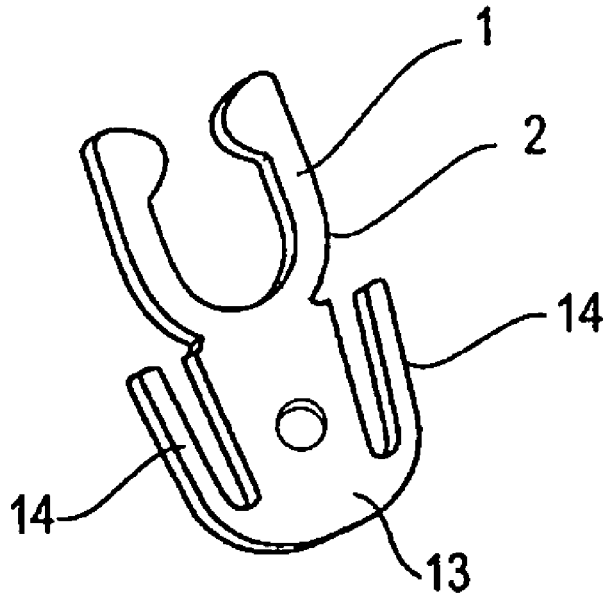
FIG. 3: shows the leaf spring of FIG. 1 in a completely coated configuration.

FIG. 3 shows an embodiment of the spring element in accordance with the invention, in which the leaf spring 1 completely has a polymer coating.

Figure 4:
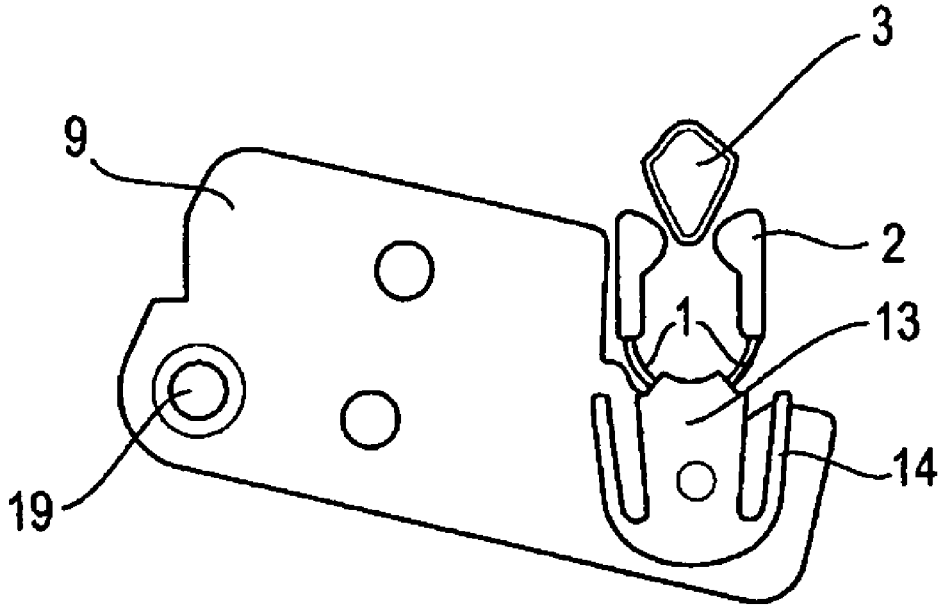
FIG. 4: shows a hinge plate with integrated spring element as shown in FIG. 3 and with a closing cam.
Figure 6:
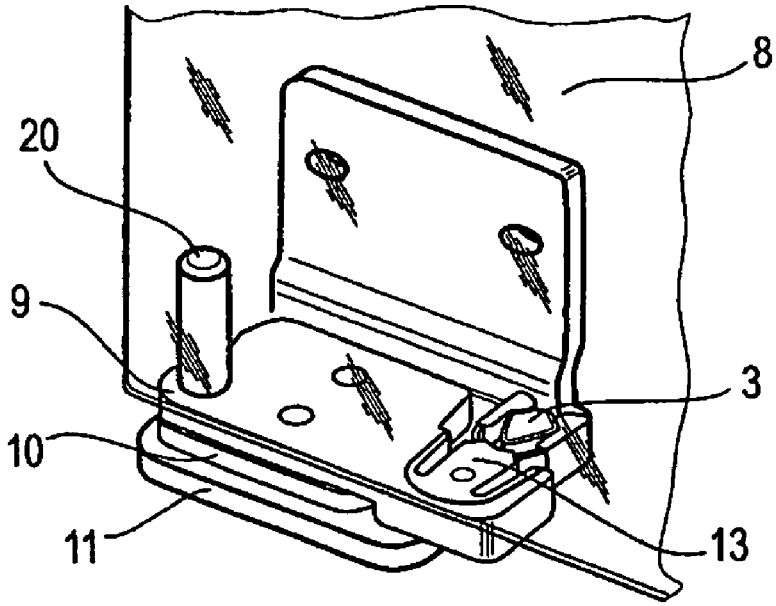
FIG. 6: shows a unit comprising an opening limiter with spring element as shown in FIG. 3 or 5.

FIG. 4 shows a hinge plate 9 with a bore 19 for receiving a bearing pin, which in FIG. 6 is designated with the reference numeral 20.

As can be taken from FIG. 4, the hinge plate includes a seat for receiving the spring element in accordance with the invention. The spring element is received and fixed in the seat by means of the spring feet 14, wherein the spring feet substantially have the function to align the spring element in the direction of the closing cam 3. In the embodiment shown here, the closing cam is stationary, i.e. arranged at the carcass or housing of the appliance.

FIG. 6 shows the arrangement with integrated hinge plate 9.

In the embodiment shown in FIG. 6, a bearing block 11 is shown, on which a bearing pin 20 is arranged. Reference numeral 10 designates an opening limiter disk, which includes a first groove in which runs a stop pin arranged on the hinge plate, and in which a second groove is arranged, in which runs a stop pin arranged on the bearing block. The arrangement of the grooves in the opening limiter disk 10 determines the maximum possible opening angle of the door, which in FIG. 6 is designated with the reference numeral 8.

Due to the arrangement of the bearing of the hinge pin on the hinge plate 9, of the stop for the door opening limiter and the seat of the spring element in one component, namely in the hinge plate 9, as shown in FIG. 6, tolerances such as settling of the door and angular displacements of the function elements are controllable. This also involves the advantage that all function elements, such as the pivot point of the hinge, the stop pin for the opening limiter, and the seat of the closing spring are combined in one component and form a very compact unit.

Of course, the invention also comprises the case that the spring element of the invention is also used without door opening limiter.

Depending on the necessary closing force, the door closer can be mounted e.g. on the upper or lower surface or on both sides of a refrigerator door.

Figure 7:
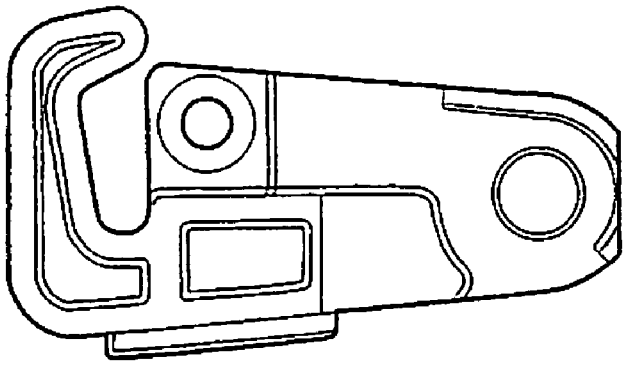
FIG. 7: shows a spring element in accordance with the prior art.

FIG. 7 shows a type of spring element in accordance with the prior art. The same is made of a polymer and includes a closing hook in a terminal region. The plastic type known from the prior art has the disadvantage that the admissible tensions in the component are small, which means that only comparatively small deformation forces and mostly small spring deflections are admissible.

Figure 8:
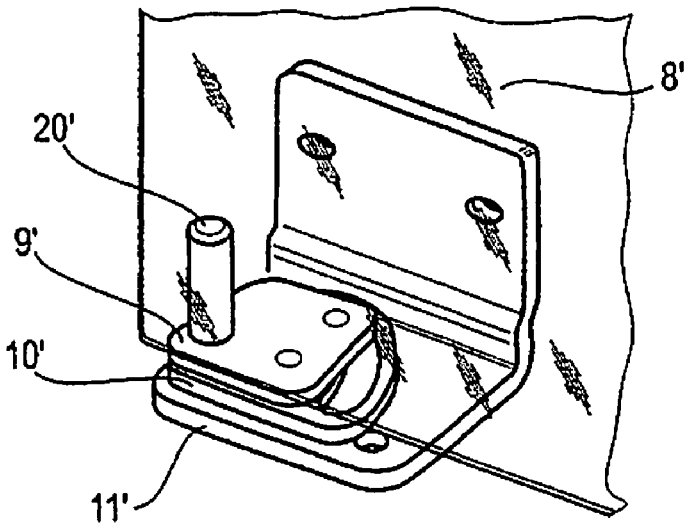
PRIOR ART FIG. 8
FIG. 8: shows an arrangement for opening limitation in accordance with the prior art.

FIG. 8 finally shows a device for opening limitation of the door, as it is known from the prior art. Reference numeral 5 designates a door-mounted hinge plate with a stop pin, reference numeral 6 an opening limiter disk with two grooves, and reference numeral 7 a bearing block with a housing-mounted stop pin. Reference numeral 8 designates the refrigerator door. The stop pin of the bearing block engages in one of the tracks of the opening limiter disk, and the stop pin engages in the other track.

The invention claimed is:

1. A device for fixing a door (8) or flap in the closed position with respect to a carcass, wherein the device includes a spring element (1), a closing cam (3) adapted to be mounted on one of said carcass or door (8) or flap as a holding element, arranged such that in the closed position of the door (8) or flap, the cam (3) and spring element (1) cooperate such that separating the spring element (1) and cam (3) from each other only is possible by applying force to the cam (3) and/or spring element (1), the spring element is a leaf spring (1) which is made of metal and at least partially coated with at least one first plastic sheathing section (2) arranged to engage the cam (3), the at least one first plastic sheathing section extending inwardly towards an opening formed by the leaf spring for receiving the cam, a spring holder (13) constituted by a second plastic sheathing section (2) coated about said leaf spring (1) and extending away from said leaf spring (1) and the at least one first plastic sheathing section, and said spring holder (13) configured to also extend in a direction away from the opening in the leaf spring (1) for receiving the cam (3) and the spring holder configured to be mounted on the other of said carcass or door (8) or flap, such that the at least one first plastic sheathing section of the leaf spring retains the closing cam in the opening in the closed position.

2. The device according to claim 1, wherein the leaf spring (1) completely has a sheathing (2).

3. The device according to claim 2, wherein the sheathing (2) is made of plastic material or includes plastic material.

4. The device according to claim 2, wherein the sheathing (2) is made by coating the leaf spring (1).

5. The device according to claim 1, wherein on the spring holder (13) one or more spring feet (14) are arranged for aligning the spring element in a seat of a hinge plate (9).

6. The device according to claim 5, wherein the spring holder (13) and/or the spring feet (14) constitute integrally formed parts.

7. The device according to claim 1, wherein the spring holder (13) and/or the spring feet (14) are made of plastic material.

8. The device according to claim 7, wherein the spring holder (13) and/or the spring feet (14) constitute injection-molded elements.

9. The device according to claim 1, wherein the leaf spring (1) is of the hook-shaped or U-shaped type.

10. The device according to claim 1, wherein the leaf spring (1) is bent in one or both of its terminal regions.

11. A device for limiting the opening angle of a door (8) or flap with respect to a carcass, including a spring element (1) for fixing the door (8) or flap in the closed position, a seat for receiving and retaining the spring element (1), a closing cam (3) adapted to be mounted on one of said carcass or door (8) or flap as a holding element, wherein in the closed position of the door (8) or flap, the cam (3) and spring element (1) cooperate such that separating the spring element (1) and the holding element (3) from each other only is possible by applying force to the cam (3) and/or spring element (1), the spring element (1) being made of metal and at least partially coated with at least one first plastic sheathing section (2) arranged to engage the cam (3), the at least one first plastic sheathing section extending inwardly towards an opening formed by the leaf spring for receiving the cam, and the spring element additionally comprising a spring holder (13) constituted by a second plastic sheathing section (2) coated about said spring element (1) and extending away from said spring element (1) and the at least one first plastic sheathing section, the spring holder configured to extend towards and be mounted in the seat for the spring element (1), such that said spring holder (13) is received in the seat, said spring (1) is mounted in the seat through said spring holder (13) and thereby on the other of said carcass or door (8) or flap and the at least one first plastic sheathing section retains the closing cam in the opening in the closed position.

12. The device according to claim 11, wherein the spring element is a leaf spring (1).

13. The device according to claim 11, wherein the device includes a hinge unit (9) to be arranged on the door (8) or flap and the spring element (1) or seat for the spring element (1) is arranged on the hinge unit (9).

14. The device according to claim 13, wherein the hinge unit includes a bore (19) for receiving a bearing pin (20).

15. The device according to claim 13, additionally comprising a bearing block (11) and an opening limiter plate or disk (10) having grooves arranged to receive stop pins respectively mounted on the bearing block (11) and hinge unit (9) and determine maximum possible opening angle of the door (8) or flap.

* * * * *